US007727027B2

(12) United States Patent
Chiang et al.

(10) Patent No.: US 7,727,027 B2
(45) Date of Patent: Jun. 1, 2010

(54) DUAL-PURPOSE SOCKET

(75) Inventors: Jui-Tu Chiang, Taipei Hsien (TW); Chia-Hsin Wang, Taipei Hsien (TW)

(73) Assignee: Taiwin Electronics Co., Ltd. (TW)

( * ) Notice: Subject to any disclaimer, the term of this patent is extended or adjusted under 35 U.S.C. 154(b) by 0 days.

(21) Appl. No.: 12/369,603

(22) Filed: Feb. 11, 2009

(65) Prior Publication Data

US 2010/0087077 A1 Apr. 8, 2010

(30) Foreign Application Priority Data

Oct. 8, 2008 (TW) ..... 97217995 U
Dec. 26, 2008 (TW) ..... 97223340 U

(51) Int. Cl.
*H01R 27/00* (2006.01)

(52) U.S. Cl. ..... 439/660; 439/378; 439/218

(58) Field of Classification Search ..... 439/660, 439/378, 218, 217, 680
See application file for complete search history.

(56) References Cited

U.S. PATENT DOCUMENTS 6,565,390 B2 * 5/2003 Wu ..... 439/680
6,899,564 B2 * 5/2005 Lee ..... 439/606
6,945,810 B1 * 9/2005 Morana et al. ..... 439/378
7,059,914 B2 * 6/2006 Tsai ..... 439/660
7,442,056 B1 * 10/2008 Ju ..... 439/79
2009/0042448 A1 * 2/2009 He et al. ..... 439/650
2009/0130873 A1 * 5/2009 He ..... 439/108
2009/0186528 A1 * 7/2009 Chen ..... 439/660

* cited by examiner

*Primary Examiner*—Gary F. Paumen
(74) *Attorney, Agent, or Firm*—Hershkovitz & Associates, LLC; Abraham Hershkovitz

(57) ABSTRACT

A dual-purpose socket has a body, pin base and a pin set. The body has a front side, a chamber defined in the body and at least one opening. The at least one opening is formed through the front side, communicates with the chamber and allows an HDMI or Displayport plug to be inserted into the chamber. The pin base is mounted in the chamber and corresponds to HDMI and Displayport plugs. The pin set is mounted on the pin base and comprises a detecting pin. When the HDMI or Displayport plug is inserted into the chamber of the body, the detecting pin will respectively not touch or touch a pin of the HDMI or Displayport plug. Since HDMI and Displayport plugs can be used, the dual-purpose socket improves convenience and cost for electronic device consumers and manufacturers.

12 Claims, 9 Drawing Sheets

DUAL-PURPOSE SOCKET

BACKGROUND OF THE INVENTION

1. Field of the Invention

The present invention relates to a dual-purpose socket for transmitting video or audio signal, and more particularly to a dual-purpose socket for use with both HDMI and Displayport plugs.

2. Description of Related Art

With development of video and audio, many kinds of interfaces have been designed for transmitting digital data of which High-Definition Multimedia Interface (HDMI) and Displayport interfaces are commonly used.

The outer shapes of the plug and connector of the two interfaces are different and have different numbers and position of the pins. For example, HDMI has two surfaces and 19 pins, with 10 pins mounted on one surface and 9 pins mounted on the other surface. Displayport has two surfaces and 20 pins, with 10 pins mounted on each surface. Therefore, the two interfaces are not interchangeable. Consumers, who buy products with incorrect interfaces or cables must change or replace sockets on their computers or use an adapter. Also factories have to produce two different connectors, which is inconvenient for consumers increases production costs and end unit price.

To overcome the shortcomings, the present invention provides a dual-purpose socket to mitigate or obviate the aforementioned problems.

SUMMARY OF THE INVENTION

The main objective of the invention is to provide a dual-purpose socket for use with HDMI and Displayport plugs.

A dual-purpose socket has a body, pin base and a pin set. The body has a front side, a chamber defined in the body and at least one opening. The at least one opening is formed through the front side, communicates with the chamber and allows an HDMI or Displayport plug to be inserted into the chamber. The pin base is mounted in the chamber and corresponds to HDMI and Displayport plugs. The pin set is mounted on the pin base and comprises a detecting pin. When the HDMI or Displayport plug is inserted into the chamber of the body, the detecting pin will respectively not touch or touch a pin of the HDMI or Displayport plug. Since HDMI and Displayport plugs can be used, the dual-purpose socket improves convenience and cost for electronic device consumers and manufacturers.

Other objectives, advantages and novel features of the invention will become more apparent from the following detailed description when taken in conjunction with the accompanying drawings.

DETAILED DESCRIPTION OF PREFERRED EMBODIMENT

Figure 1:
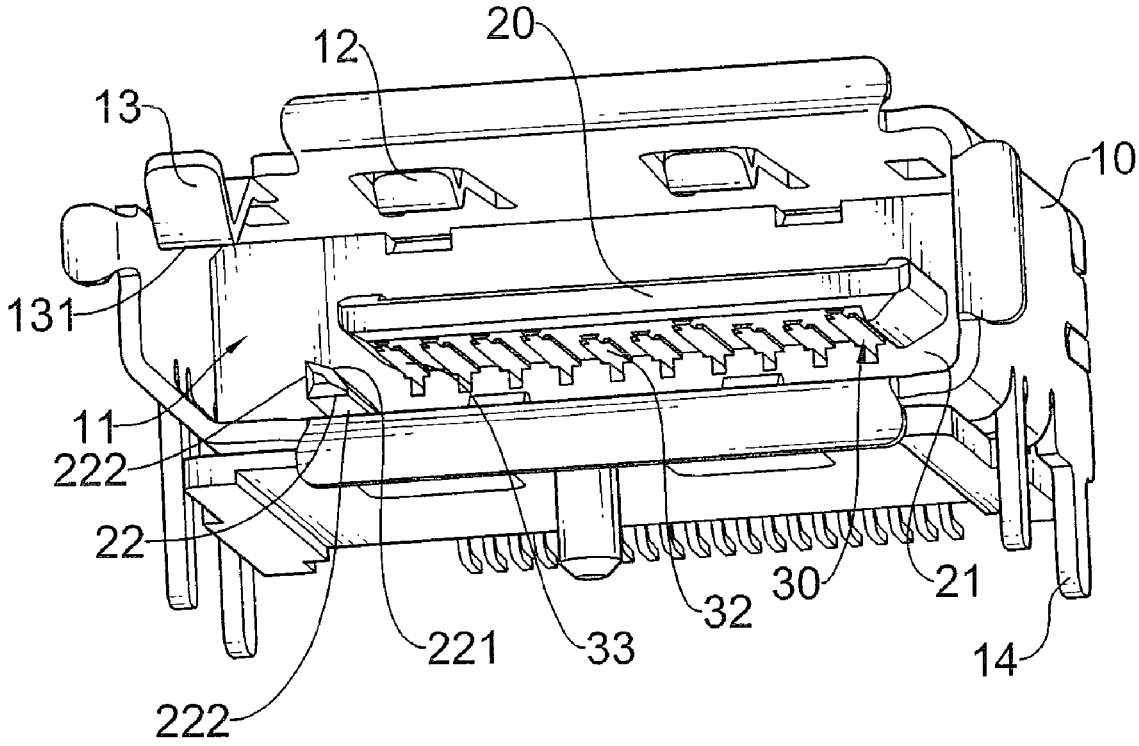
FIG. 1 is a perspective view of a dual-purpose socket in accordance with the present invention.
Figure 2:
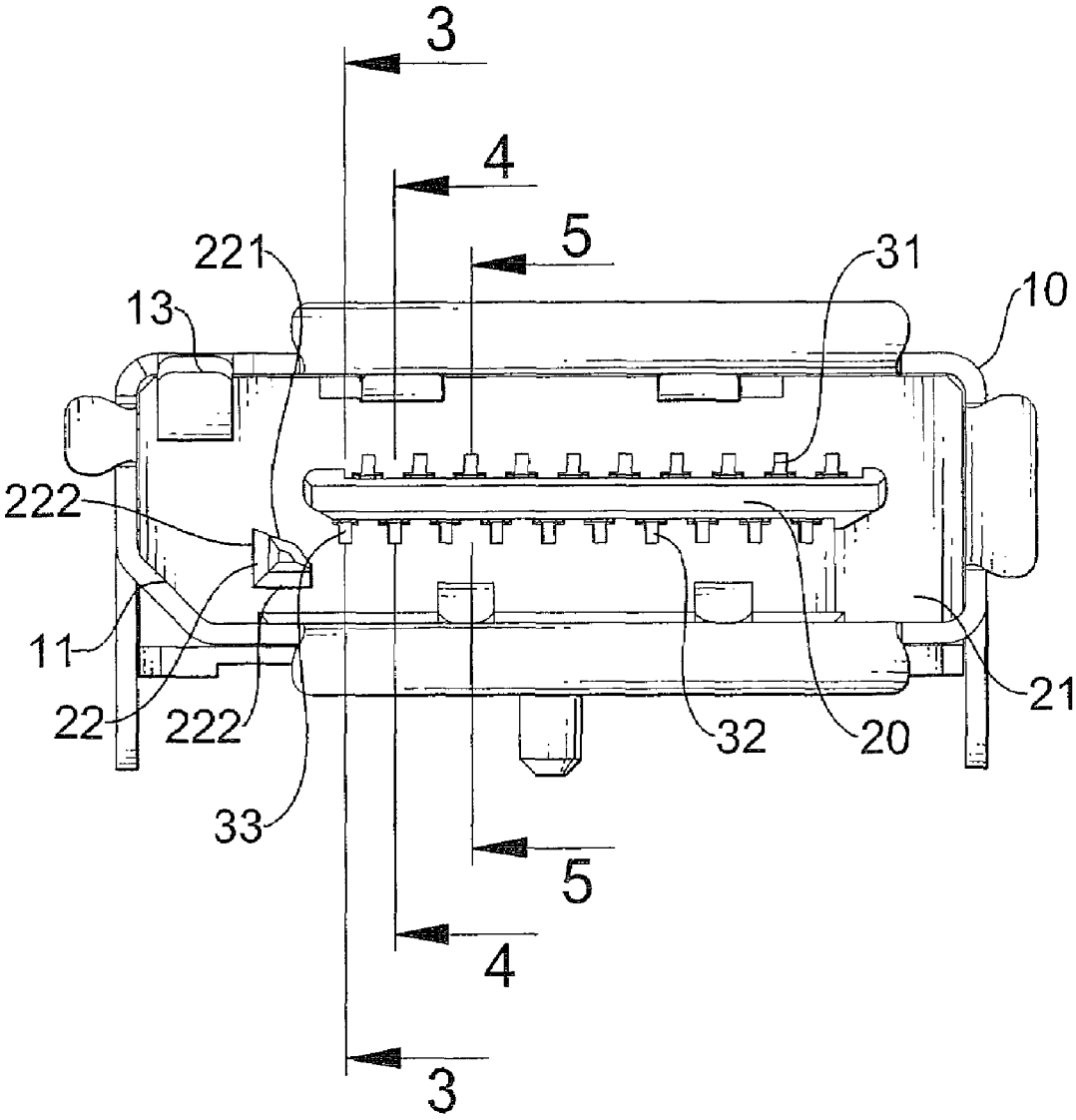
FIG. 2 is a front view of the dual-purpose socket in FIG. 1.

With reference to FIGS. 1, 2, 6 and 11, a dual-purpose socket comprises a body (10), a pin base (20), a pin set (30) and at least one guide protrusion (22, 22A) and may further have an electronic device. The dual-purpose socket can be electronically mounted on a PCB with a chip of an electronic device.

The body (10) has a front side, a chamber (11) defined in the body (10), an inner surface (21) and at least one opening and may further have an arm (13), a top, a bottom, multiple resilient tabs (12), two sides opposite to each other and multiple mounting protrusions (14). The inner surface (21) is in the chamber (11). The at least one opening is formed through the front side, communicates with the chamber (11) and allows HDMI or Displayport plugs (40, 50) to be inserted into the chamber (11).

The arm (13) is resilient and protrudes from the opening of the body (10) and has a pressing portion (131) protruding into the chamber (11). The resilient tabs (12) are formed in the top and bottom and protrude into the chamber (11) of the body (10), and four resilient tabs (12) respectively formed in the top and bottom may be implemented. The two sides are opposite to each other and adjacent to the front side. The multiple mounting protrusions (14) are formed on the two sides and protrude downward for mounting to a casing, PCB or the like. The pin base (20) is mounted on the inner surface (21), protrudes longitudinally toward the opening of the body (10) and corresponds to HDMI and Displayport plugs (40, 50) and may have two opposite sides, an upper surface and a lower surface.

Figure 3:
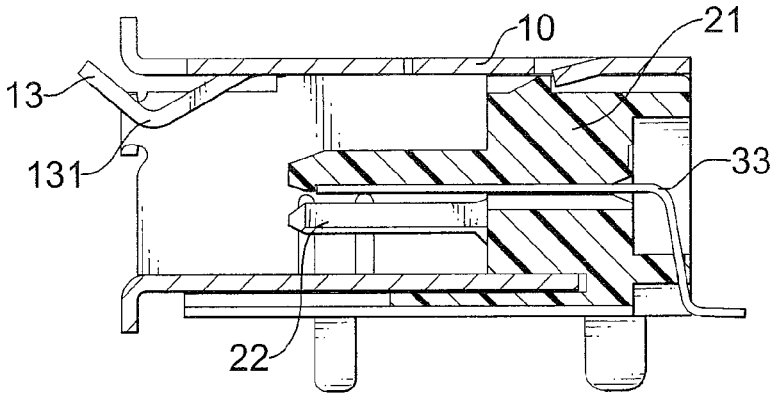
FIG. 3 is a side view in partial section taken along line 3-3 of the dual-purpose socket in FIG. 2.
Figure 4:
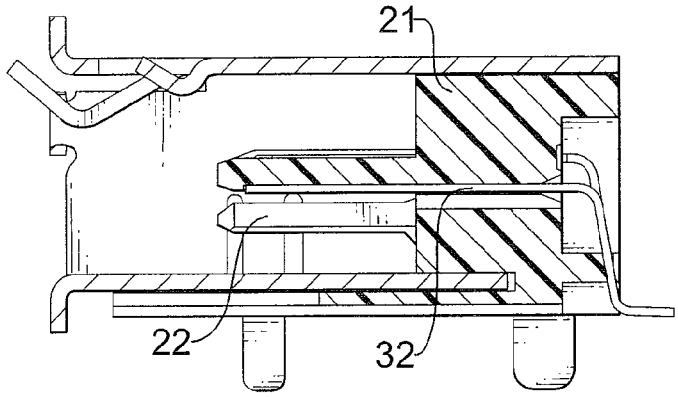
FIG. 4 is a side view in partial section taken along line 4-4 of the dual-purpose socket in FIG. 2.
Figure 5:
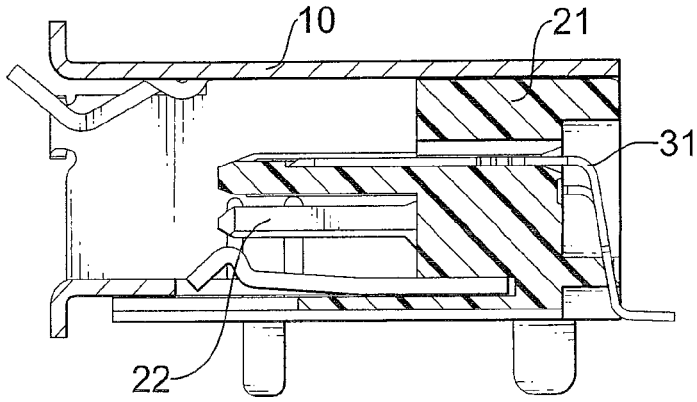
FIG. 5 is a side view in partial section taken along line 5-5 of the dual-purpose socket in FIG. 2.

With further reference to FIG. 3 to FIG. 5, the pin set (30) is mounted on the pin base (20) and comprises upper pins (31), lower pins (32) and a detecting pin (33). The upper pins (31) are mounted on the pin base (20) at intervals, may be mounted on the upper surface of the pin base (20) and ten upper pins (31) may be implemented. The lower pins (32) are mounted on the pin base (20) at intervals, may be mounted on the lower surface of the pin base (20) and nine lower pins (32) may be implemented. The detecting pin (33) is mounted on the pin base (20) and may be mounted on the lower surface of the pin base (20) and may abut to a side of the pin base (20). The pin set (30) may be electrically connected to the electronic device.

Figure 12:
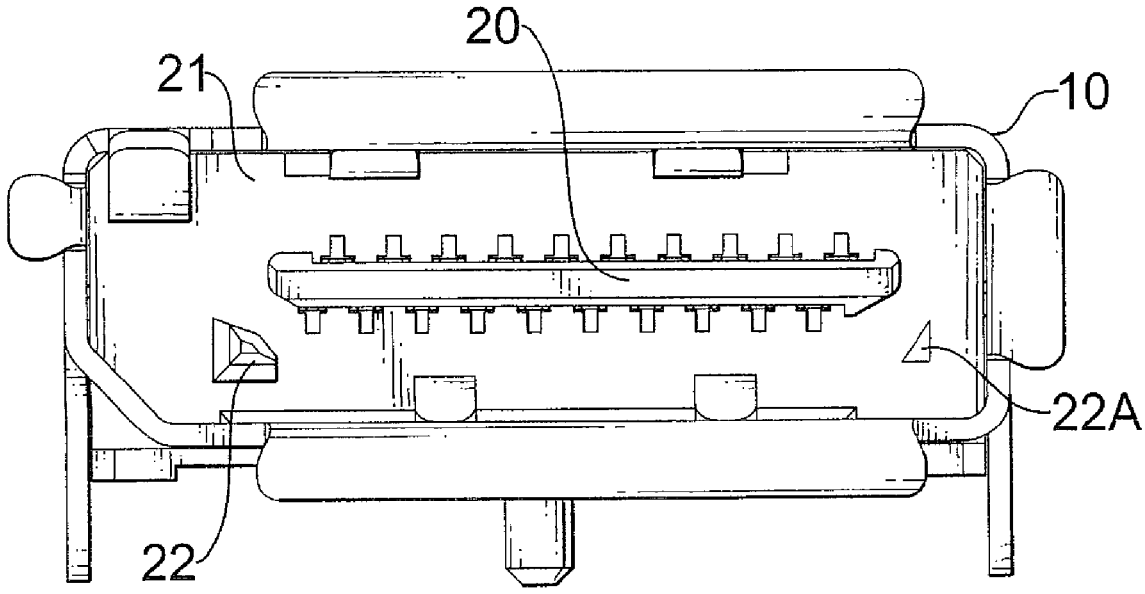
FIG. 12 is a front view of the dual-purpose socket in FIG. 11.
Figure 13:
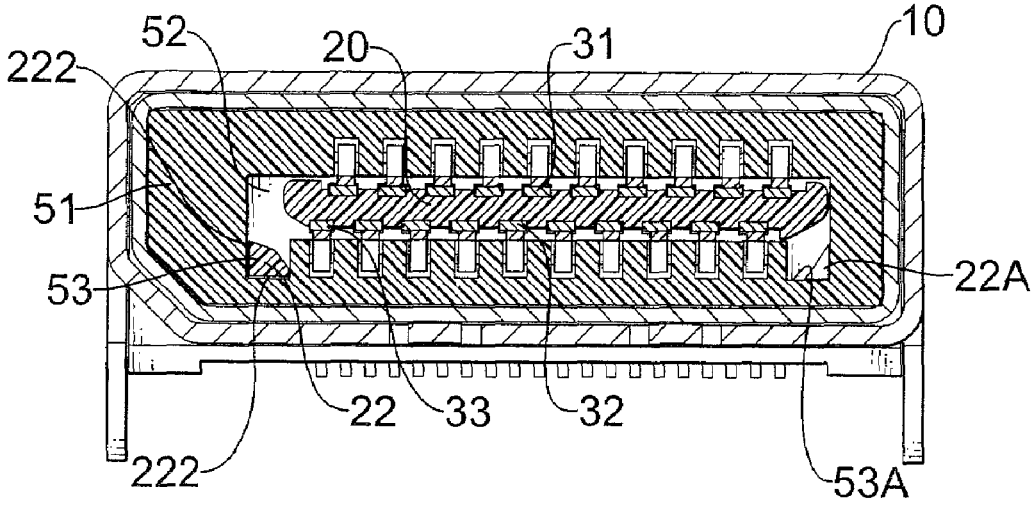
FIG. 13 is a front view of the dual-purpose socket in FIG. 11 shown connected with a Displayport socket.
Figure 14:
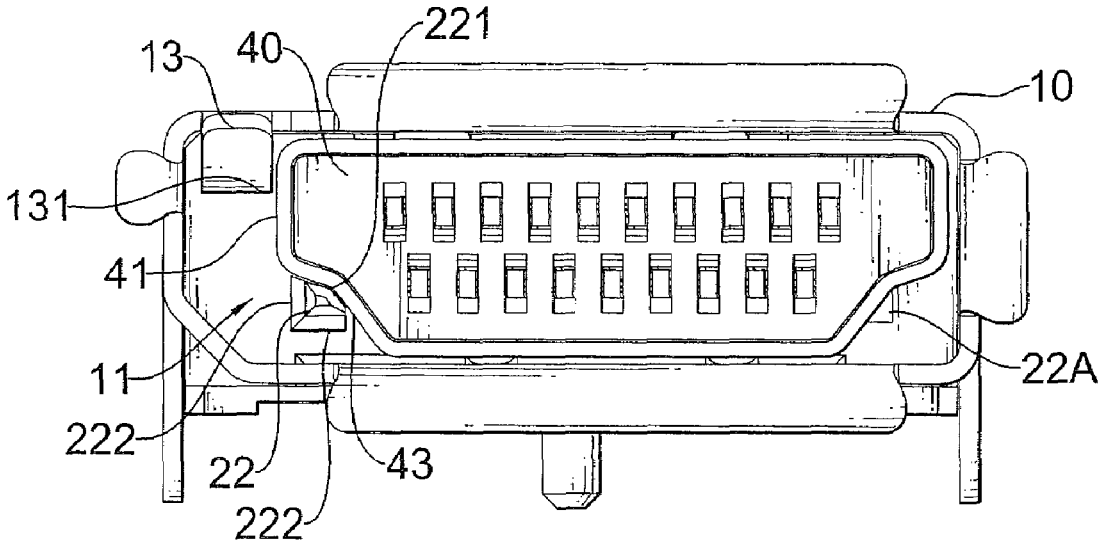
FIG. 14 is a front view in partial section of the dual-purpose socket in FIG. 11 shown connected with the HDMI socket.

With further reference to FIG. 12, the at least one guide protrusion (22, 22A) is mounted in the inner surface (21) of the chamber (11) and may be adjacent to the detecting pin (33), and protrudes longitudinally from the inner surface (21)

into the chamber (11) of the body (10) and may have a cambered surface (221) adjacent to the pin base (20) and two perpendicular surfaces (222) adjacent to the inner surface (21) of the chamber (11). Two guide protrusions (22, 22A) may be implemented and may be respectively adjacent to the two sides of the pin base (20). Furthermore, the at least one guide protrusion (22, 22A) is separated from the pin base (20) to define a socket hole having a first receiving space and a second receiving space for alternatively receiving a HDMI plug or a Displayport plug.

Figure 6:
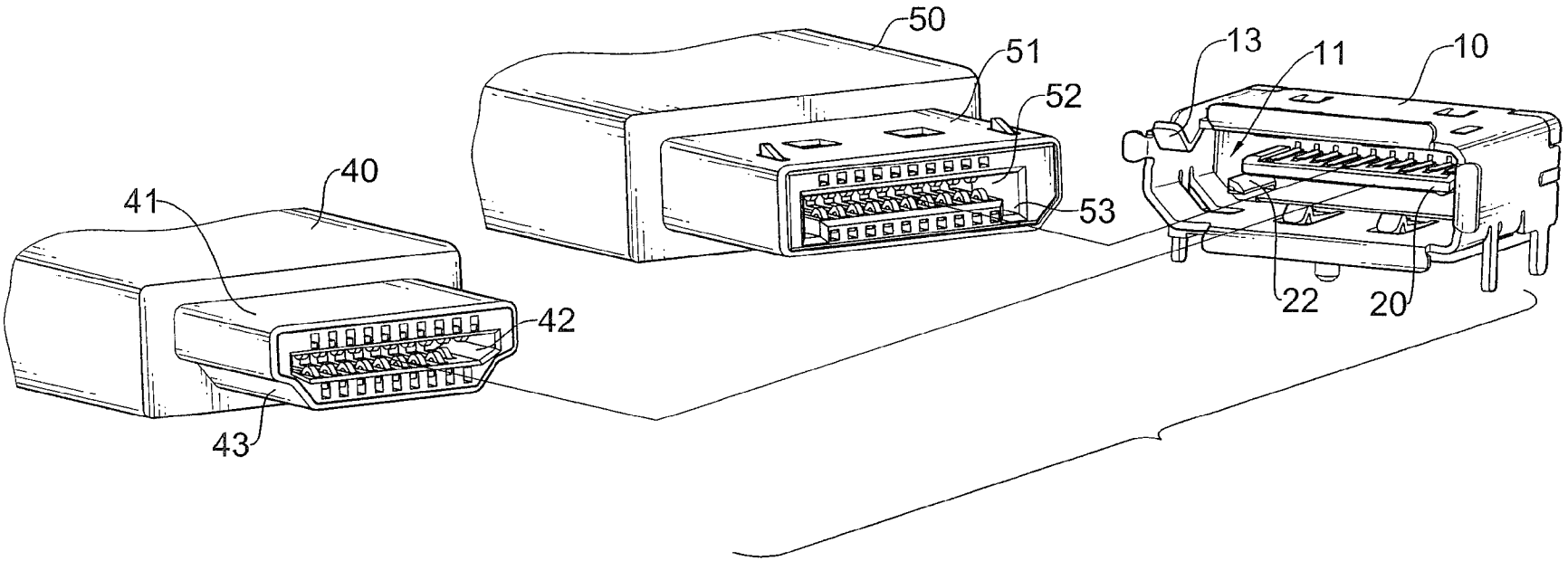
FIG. 6 is a perspective view of the dual-purpose socket in FIG. 1 and HDMI and Displayport plugs.

With reference to FIG. 6, the HDMI plug (40) has a bayonet portion (41) and nineteen pins. The bayonet portion (41) has a front side and a slot (42). The slot (42) is formed in the front side and corresponds to the pin base (20). The bayonet portion (41) is trapezoidal and has at least one inclined surface (43). The inclined surface (43) of the HDMI plug (40) corresponds to and abuts the cambered surface (221) of the at least one guide protrusion (22, 22A). The pins are mounted in the slot (42) of the bayonet portion (41).

The Displayport plug (50) has a bayonet portion (51) and twenty pins. The bayonet portion (51) has a front side and a slot (52). The slot (52) is formed in the front side, corresponds to the pin base (20) and has an inner surface and at least one groove (53, 53A). The inner surface of the slot (52) has two edges opposite to each other. The at least one groove (53, 53A) is formed on an edge of the inner surface, corresponds to and abuts the perpendicular surfaces (222) of the at least one guide protrusion (22, 22A). The pins are mounted in the slot (52) of the bayonet portion (51).

Figure 7:
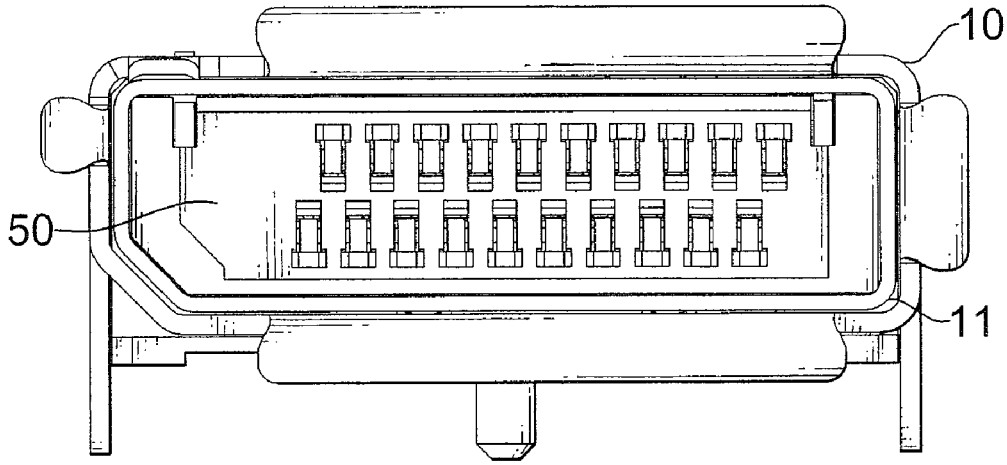
FIG. 7 is a front view of the dual-purpose socket in FIG. 1 shown connected to a Displayport plug.
Figure 8:
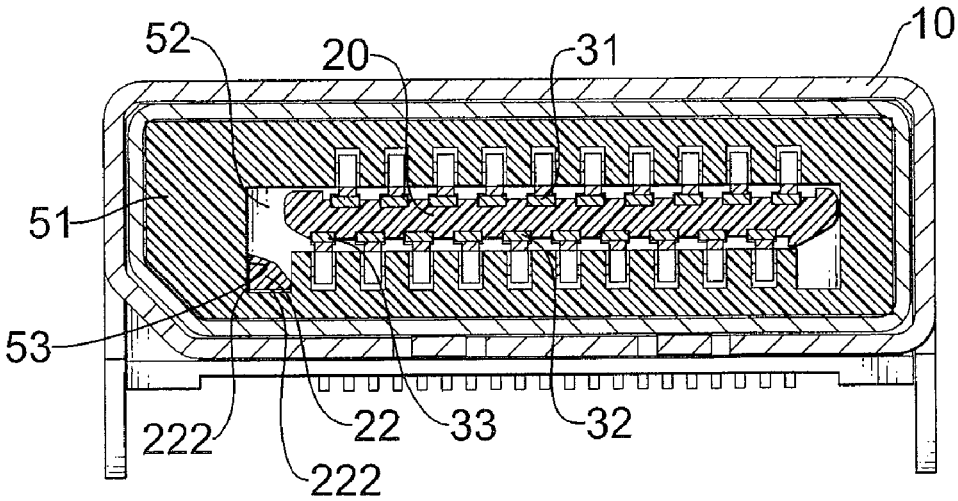
FIG. 8 is a front view in partial section of the dual-purpose socket in FIG. 7 shown connected with the Displayport plug.
Figure 9:
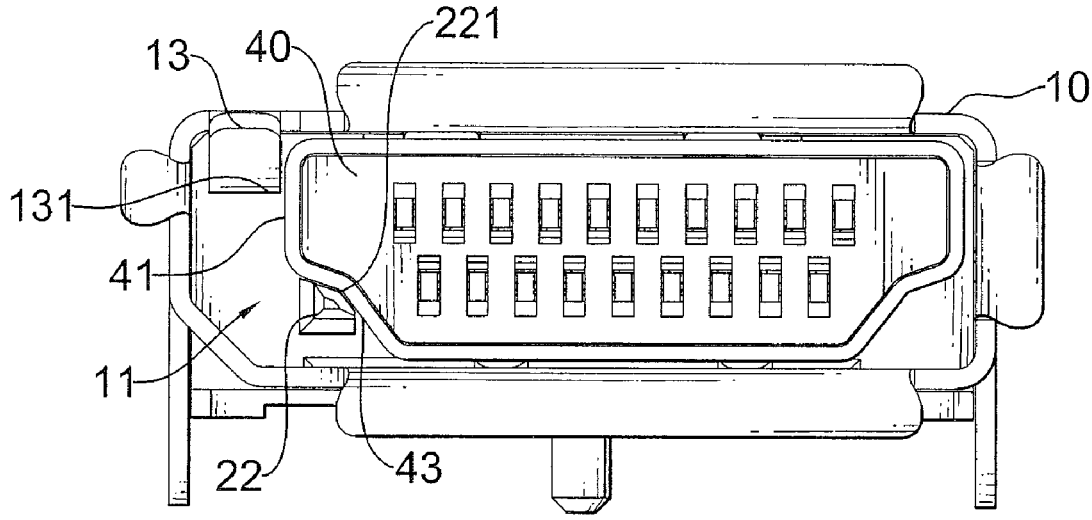
FIG. 9 is a front view of the dual-purpose socket in FIG. 1 shown connected with the HDMI socket.
Figure 10:
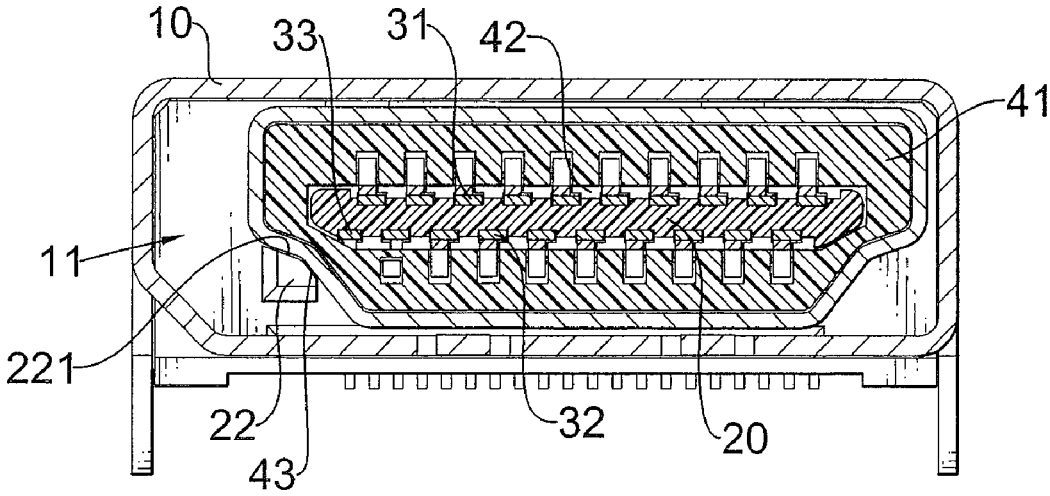
FIG. 10 is a front view in partial section of the dual-purpose socket in FIG. 1 shown connected with the HDMI socket.
Figure 11:
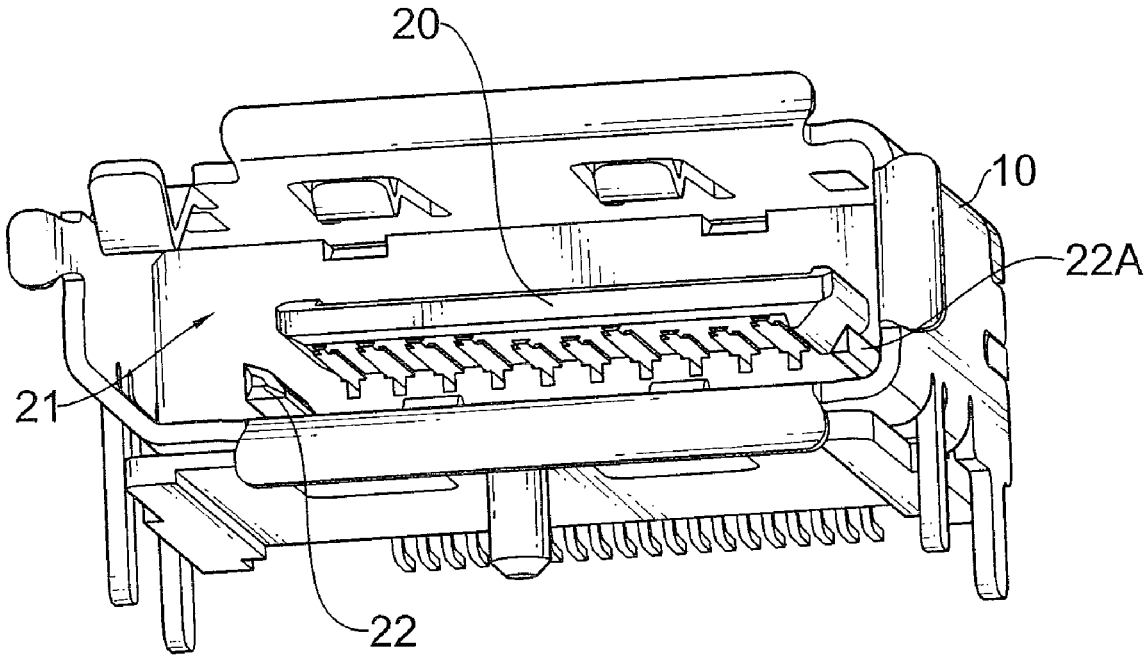
FIG. 11 is a perspective view of a second embodiment of the dual-purpose socket in accordance with the present invention.

With further reference to FIGS. 7 and 8, when the Displayport plug (50) is inserted into the chamber (11) of the body (10), the pin base (20) is inserted into the slot (52) of the bayonet portion (51), the at least one guide protrusion (22, 22A) abuts the corresponding inclined surface (53, 53A) to guide and stabilize the Displayport plug (50) in the chamber (11) and the pins of the pin set (30) including the detecting pin (33) respectively contact the pins of the Displayport plug (50). The PCB of the electronic device can receive or send out a signal from the detecting pin (33) via touching the pin of the Displayport plug (50) so the chip can identify the Displayport plug (50) and then receive or send out the right signal. The resilient tabs (12) press the bayonet portion (51) of Displayport for a stable connection.

With further reference to FIG. 9, FIG. 10, FIG. 13 and FIG. 14, when the HDMI plug (40) is inserted into the chamber (11) of the body (10), the pin base (20) is inserted into the slot (42) of the bayonet portion (41), the cambered surface (221) of at least one guide protrusion (22, 22A) abuts and presses the corresponding inclined surface (43) to guide and stabilize the HDMI plug in the chamber (11) and the pins of the pin set (30), except the detector pin (33), respectively and electrically contact the pins of the HDMI plug (40). The PCB does not receive signal from the detecting pin (33) so the chip can determine the HDMI plug (40) and receive or send out a signal through the upper pins (31) and the lower pins (32). The pressing portion (131) of the arm (13) and the resilient tabs (12) can press the bayonet portion (41) of HDMI for a stable connection.

Despite the differences between HDMI and Displayport plugs (40, 50), a signal can be transmitted through the dual-purpose socket. Thus dual-purpose sockets in accordance with the present invention can be mounted and built into electronic devices, such as but not limited to televisions, notebook computers, desktop computers, monitors, hard-drives, optical disc players, digital video recorders or the like to conveniently connect both HDMI and Displayport connectors so only one socket need be supplied for improved convenience, simplicity and reduced size and cost.

Even though numerous characteristics and advantages of the present invention have been set forth in the foregoing description, together with details of the structure and function of the invention, the disclosure is illustrative only. Changes may be made in detail, especially in matters of shape, size, and arrangement of parts within the principles of the invention to the full extent indicated by the broad general meaning of the terms in which the appended claims are expressed.

What is claimed is:

1. A dual-purpose socket comprising:

a body having a front side;

a chamber being defined in the body;

an inner surface; and at least one opening being formed through the front side, communicating with the chamber and allowing an HDMI (High-Definition Multimedia Interface) plug or a Displayport plug to be inserted into the chamber;

a pin base mounted on the inner surface and in the chamber of the body, and corresponding to the HDMI plug and the Displayport plug;

a pin set mounted on the pin base and having upper pins, lower pins and a detecting pin mounted on the pin base at intervals;

at least one guide protrusion mounted on the inner surface of the body and protruding longitudinally from the inner surface into the chamber of the body, the at least one guide protrusion being separated from the pin base to define a socket hole having a first receiving space and a second receiving space for alternatively receiving the HDMI plug or the Displayport plug.

2. The dual-purpose socket as claimed in claim 1, wherein the pin base has two sides opposite to each other; and two guide protrusions are mounted on the inner surface of the body and respectively adjacent to the two sides of the pin base.

3. The dual-purpose socket as claimed in claim 1, wherein the body further has an arm being resilient and protruding from the opening of the body and having a pressing portion protruding into the chamber of the body.

4. The dual-purpose socket as claimed in claim 2, wherein the body further has an arm being resilient and protruding from the opening of the body and having a pressing portion protruding into the chamber of the body.

5. The dual-purpose socket as claimed in claim 1, wherein the pin base has an upper surface and a lower surface;

the upper pins are mounted on the upper surface;

the lower pins are mounted on the lower surface; and the detecting pin is mounted on the lower surface and is adjacent to a guide protrusion.

6. The dual-purpose socket as claimed in claim 2, wherein the pin base comprises an upper surface and a lower surface;

the upper pins are mounted on the upper surface;

the lower pins are mounted on the lower surface; and the detecting pin is mounted on the lower surface, wherein one guide protrusion is adjacent to the detecting pin.

7. The dual-purpose socket as claimed in claim 3, wherein the outer surface of the pin base comprises an upper surface and a lower surface;

the upper pins are mounted on the upper surface;

the lower pins are mounted on the lower surface; and the detecting pin is mounted on the lower surface and is adjacent to a guide protrusion.

8. The dual-purpose socket as claimed in claim 4, wherein the outer surface of the pin base comprises an upper surface and a lower surface;

the upper pins are mounted on the upper surface;

the lower pins are mounted on the lower surface; and the detecting pin is mounted on the lower surface, wherein one guide protrusion is adjacent to the detecting pin.

9. The dual-purpose socket as claimed in claim 5, wherein the at least one guide protrusion has a cambered surface adjacent to the pin base.

10. The dual-purpose socket as claimed in claim 6, wherein each guide protrusion has a cambered surface adjacent to the pin base.

11. The dual-purpose socket as claimed in claim 7, wherein the at least one protrusion has a cambered surface adjacent to the pin base.

12. The dual-purpose socket as claimed in claim 8, wherein each guide protrusion has a cambered surface adjacent to the pin base.

* * * * *